US006258049B1

(12) United States Patent
Partian

(10) Patent No.: US 6,258,049 B1
(45) Date of Patent: Jul. 10, 2001

(54) HYDROMASSAGER

(76) Inventor: Syrus Jacob Partian, 1992 NW. 166 Ave., Pembroke Pines, FL (US) 33028

( * ) Notice: Subject to any disclaimer, the term of this patent is extended or adjusted under 35 U.S.C. 154(b) by 0 days.

(21) Appl. No.: 09/337,832

(22) Filed: Jun. 22, 1999

Related U.S. Application Data

(60) Provisional application No. 60/115,414, filed on Jan. 11, 1999.

(51) Int. Cl.[7] ..... A61H 9/00

(52) U.S. Cl. ..... 601/154; 601/159; 601/169; 601/55

(58) Field of Search ..... 601/154, 159, 601/160, 165, 169, 155, 15, 18, 55

(56) References Cited

U.S. PATENT DOCUMENTS 4,926,510 * 5/1990 Watkins ..... 601/148
5,634,888 * 6/1997 Henkin et al. ..... 601/155

* cited by examiner

*Primary Examiner*—Danton D. DeMille
*Assistant Examiner*—Benjamin Koo

(57) ABSTRACT

The hydromassager employs water pressure for massage in a closed-system The general advantages of this equipment such as compactness, mobility, safety, and many others make this machine ideal for a variety of settings. Pump (2) pressures water and directs it towards contact surface (12) that is in contact with the subject's body surface. From the massaging head water returns to water reservoir (1).

1 Claim, 3 Drawing Sheets

HYDROMASSAGER

CROSS-REFERENCE TO RELATED APPLICATIONS

This application is entitled to the benefit of Provisional Patent Application Ser. No. 60/115,414, filed Jan. 11, 1999.

STATEMENT REGARDING FEDERALLY SPONSORED RESEARCH OR DEVELOPMENT

Not applicable.

REFERENCE TO A MICROFICHE APPENDIX

Not applicable.

BACKGROUND-FIELD OF INVENTION

This invention relates to application of water pressure for massage.

BACKGROUND-DISCUSSION OF PRIOR ART

Two different methods are employed to utilize water pressure for massage: direct-contact method and indirect-contact method. In the direct-contact method pressurized water is projected directly onto the subject's body surface; JACUZZI and HAND HELD TAP WATER POWERED WATER DISCHARGE APPARATUS (Melvyn L. Henkin and Jordan M. Laby, U.S. Pat. No. 5,634,888, Filed Jun. 3, 1997) are examples of the direct-contact method of massagers. The indirect-contact method places a flexible diaphragm between the projected water and the subject's body surface. BODY MASSAGE APPARATUS (David B. Marlin and Earl B. Marlin, U.S. Pat. No. 4,976,256, Filed Jun. 20, 1989), HAND HELD DRY HYDRO-MASSAGE UNIT FOR A SPA (Jonathan Watldns, U.S. Pat. No. 4,926,510, Filed May 22, 1990), and HYDROMASSAGER (the present invention) are all examples in this category.

In the direct-contact method the pressurized water is directly projected onto the skin of the subject. This may aggravate skin lesions. It also removes natural oils and moisturizers of the skin, causing sin dryness. In this method of massage the subject has to undress that may not be practical all the times.

Hydromassagers also can be classified into open-system and closed-system massagers according to the source of water they utilize. The closed-system massagers are those that are self-contained all the water they need to operate. They do not require any pluming for water inlet or outlet. Examples in this category include BODY MASSAGE APPARATUS (Marlin) and HYDROMASSAGER (the present invention). The open-system massagers are those that have to be connected to an external source of water to operate. Examples in this category include JACUZZI, HAND HELD TAP WATER POWERED WATER DISCHARGE APPARATUS (Henkin), and HAND HELD DRY HYDRO-MASSAGE UNIT FOR SPA (Watkins). Hydromassagers also can be classified according to the mobility of the massaging unit (the part of the apparatus that will be in contact with the subject's body). Accordingly, the massaging unit can be stationary (JACUZZI and BODY MASSAGE APPARATUS) or mobile (both HAND HELD massagers mentioned in this application, and HYDROMASSAGER). In summary, the HYDROMASSAGER is an indirect massager that operates in a closed-system and has a mobile massaging head. The closest invention to HYDROMASSAGER is Watkins' that is an open-system massager.

BODY MASSAGE APPARATUS (David B. Marlin and Earl B. Marlin, U.S. Pat. No. 4,976,256, Filed Jun. 20, 1989) is a closed-system massager that uses the indirect method for massage. This apparatus looks like a bed. Water pumps are located in the place of the matters and the flexible diaphragm is located in place of the bed cover. The subject lies on the flexible diaphragm, then the pressured water is projects on the flexible diaphragm The subject can adapt either prone or supine positions. These two body positions restrict the areas of the body that can receive massage. For example, the SCM muscle (in front of the neck) can not receive massage from this device. Jacuzzi and Body Massage Apparatus are bulky and often need a large and permanently allocated location. The Hydromassager is designed to avoid these problems and to offer more.

HANDHELD DRY HYDRO-MASSAGE UNIT FOR A SPA (Jonathan Watkins, U.S. Pat. No. 4,926,510, Filed May 22, 1990) is an open-system massager that employs the indirect method of massaging. In this apparatus, inside a massaging head the pressurized water is directed towards a flexible surface that is in contact with the subject's body surface. The water to the massaging head is supplied by an external source, in this case a spa tub. Thus the apparatus is an open-system massager, an external source of water has to provide water to this massager. This limits the operating location of the apparatus to vicinity of a water source.

HANDHELD TAP WATER POWERED WATER DISCHARGE APPARATUS (Melvyn L. Henidn and Jordan M Laby, U.S. Pat. No. 5,634,888, Filed Jun. 3, 1997) is an open-system massager that utilizes the direct-contact method. In this apparatus the tap water is directly projected onto the subject's skin surface. Like the Jacuzzi water projection on the skin can irritate the skin lesions and can result into the skin dryness. Besides, a large amount of hot and cold water is consumed in the process of massaging.

SUMMARY

The hydromassager is a closed-system massager with a mobile massaging head It retains and carries all the water it needs to operate. It does not need water inlet or water outlet. It retains all the water as long as there is no opening in the system. A water pump that is placed in a water reservoir pressurizes and directs water from the reservoir towards a portable massaging head via a flexible hose. From the massaging head water returns to the reservoir via a second flexible hose, thus the subject can adapt different body positions as desires and place himself close to the reservoir to have access to the controlling panel that is located on the water reservoir. Through the control panel the subject can control the operating time of the pump, the pressure of the pump, and the temperature of the water. As an option, the reservoir can be equipped with a heating element, a cooling device and other features that may be useful in this apparatus.

This device does not require pluming or allocation of a permanent site. The subject can adapt different body positions as desires and remain dressed during the massage.

BRIEF DESCRIPTION OF THE SEVERAL VIEWS OF THE DRAWINGS

In the drawings, closely related figures have the same number but different alphabetic suffixes; also components of a piece have the same number but different alphabetic suffixes.

REFERENCE NUMERALS IN DRAWINGS

Figure 1:
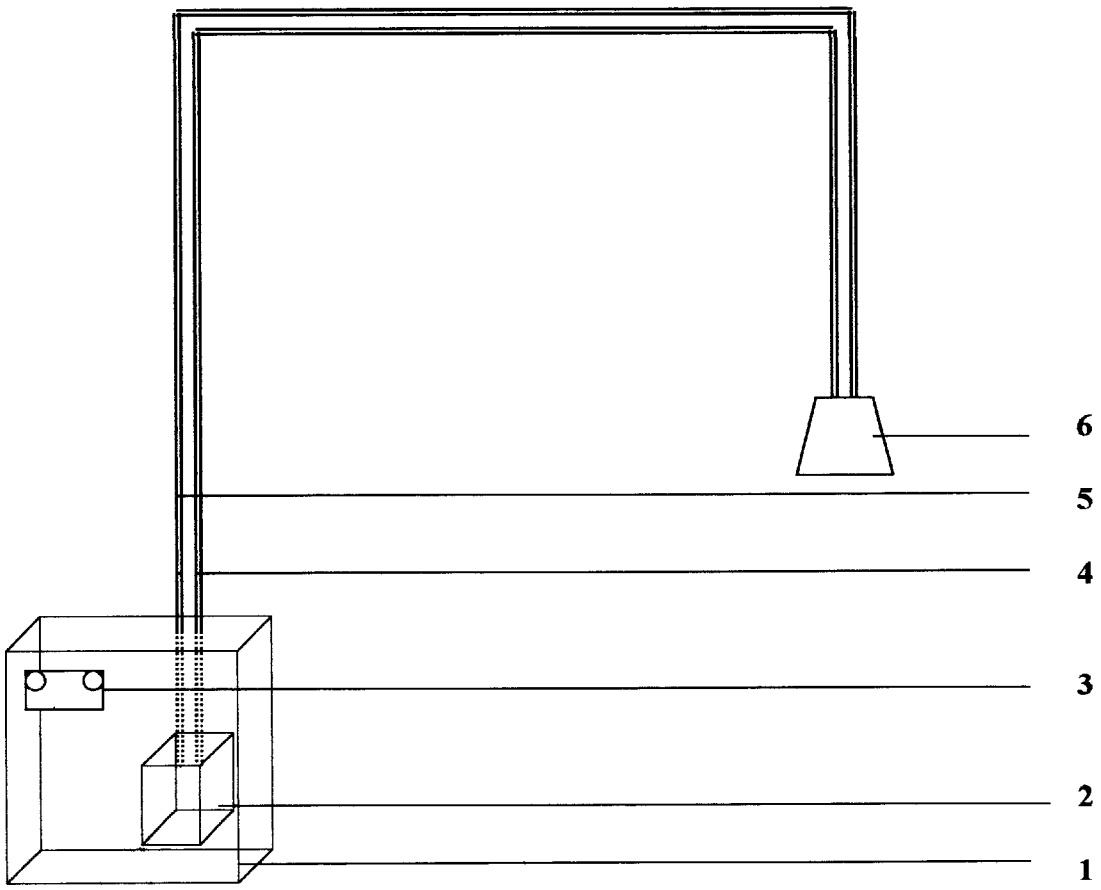
FIG. 1 shows the general features of the equipment.

(1) water reservoir
(2) pump
(3) control panel
(4) flexible hose
(5) flexible hose
(6) massaging head
(7) coiled pipe
(8) pivoting joint
(9) outer shell
(10) inner shell
(11) hook
(12) contact surface

DETAILED DESCRIPTION OF THE INVENTION

The general features of the equipment are shown in FIG. 1. A pump (2) regulates the water pressure inside a closed system. From a water reservoir (1) water is pumped to a massaging head (6) by water transferring means (in this paper flexible hoses (4) and (5) are employed for the purpose of illustrations). From massaging head (6) water returns to reservoir (1) via hose (5). Massaging head (6) can be positioned at different heights and angles; thus, the subject has freedom to choose different body positions.

Figure 2A:
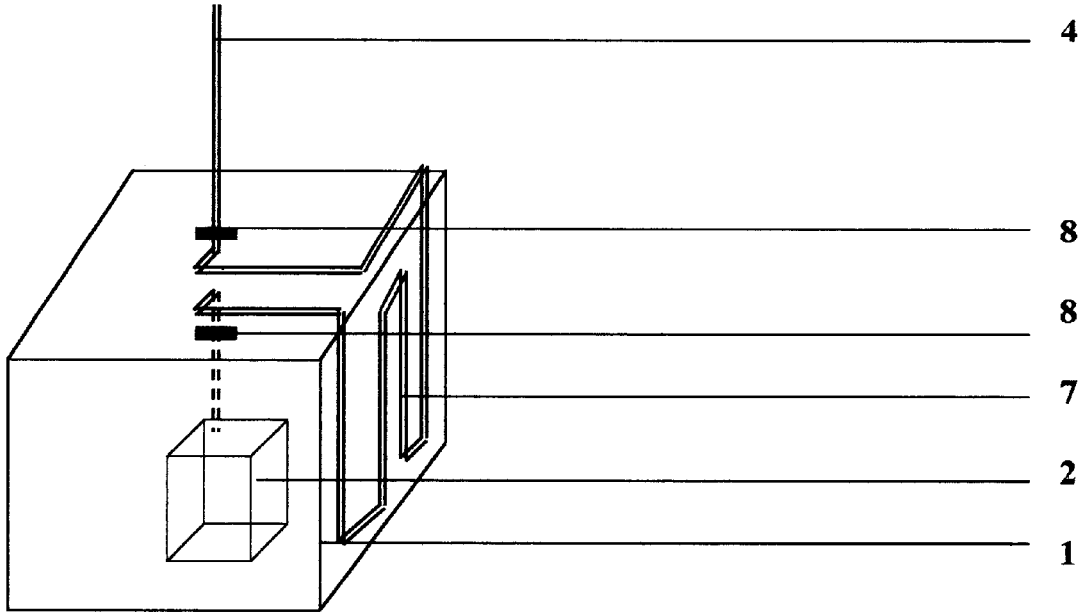
FIG. 2A shows a manual cooing system in a closed position.
Figure 2B:
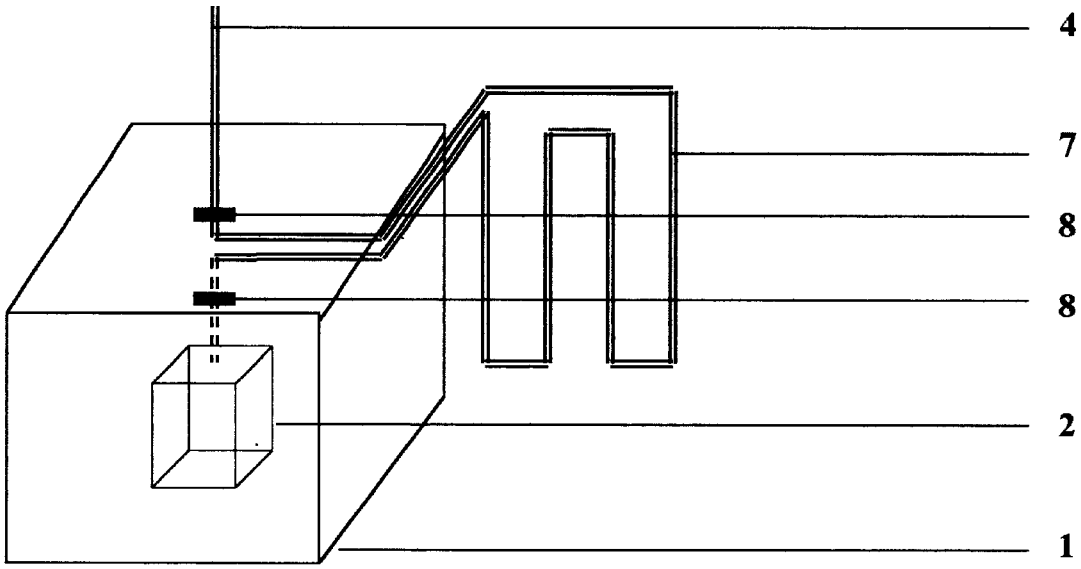
FIG. 2B shows the manual cooling system in an open position.

A manual cooling system is shown in FIG. 2. A coiled pipe (7) is connected to water reservoir (1) and to hose (4) or (5). Coiled pipe (7) can pivot around two joints (8) to positions shown in FIG. 2A and FIG. 2B. When coiled pipe (7) is in the position shown in FIG. 2B (in this Fig., water reservoir (1) is rotated clockwise 90 degrees for visualization purposes), it can be placed in a bucket of ice and water in order manually lower the temperature of the water. An electric refrigerating system can be employed as the cooling system as welt A heating element (is not shown) can be placed in reservoir (1) to heat the water.

Figure 3:
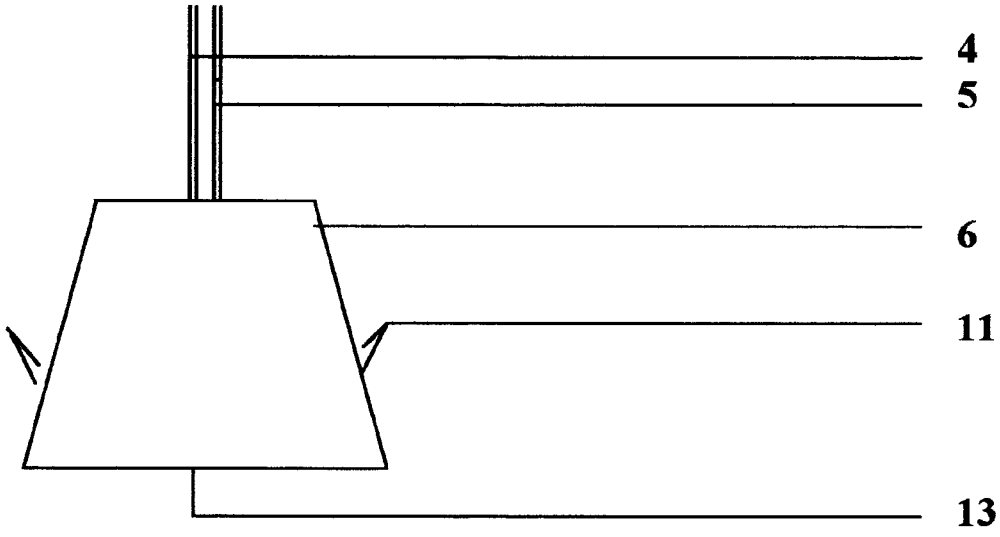
FIG. 3 shows two attachment hooks on the surface of a massaging head.

FIG. 3 shows mechanism of attachment of massaging head (6) to the subject's body. Two hooks (11) are located on the surface of an outer shell of massaging head (6). Hooks (11) are 180 degrees apart. An elastic strap and hooks (11) can be employed to fix massaging head (6) on the subject's body surface.

Figure 4:
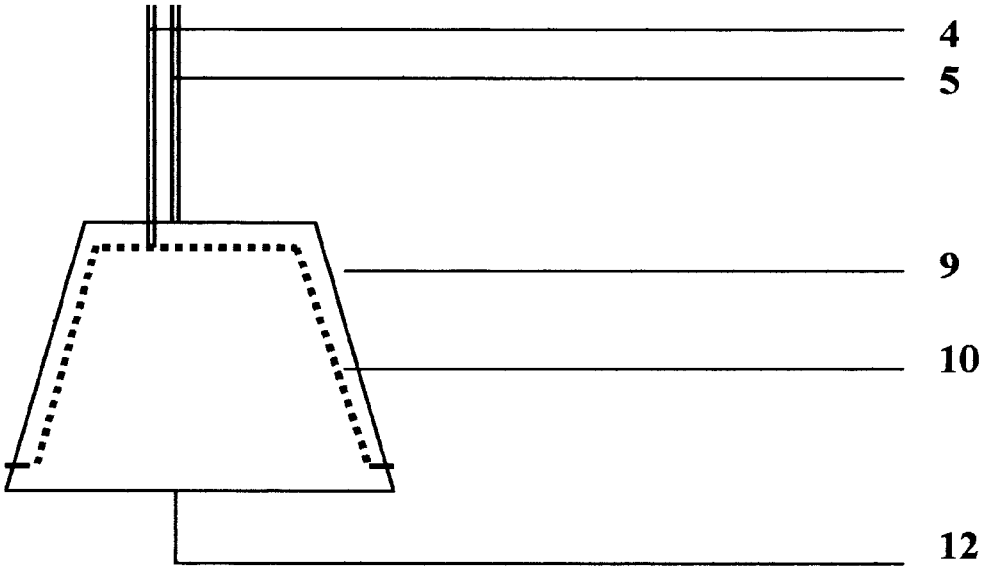
FIG. 4 shows inner and outer shells of the massaging head and their relationships to two flexible hoses.

FIG. 4 shows two shells of massaging head (6). An inner shell (10) is perforated to allow water from the massaging head to be sucked into the flexible hose that returns water into the reservoir. A flexible contact surface (12) is part of an outer shell (9) that comes in contact with the subject's body. Through contact surface (12), massage is applied. Massaging head (6) also has outer shell (9) that is water impermeable.

From the above description, a number of advantages of my invention become evident.

(a) The subject has no contact with water, thus does not need to undress.

(b) The massage can be applied at different body positions that the subject adapts. This can be advantageous in case of an acute condition.

(c) The device can be mobile and can be stored in a closet; therefore it does not require allocation of a permanent location.

(d) The device can be used in a variety of settings, such as: hospital, home, Doctor's office, gymnasium, school, and more.

(e) No pluming is needed.

(f) The temperature of the water can be adjustable from ice-cold to hot.

(g) The pressure of the projected water can be adjusted to fit the needs.

Application of the hydromassager is very simple. The subject can adapt different body positions and can remain dressed. An elastic band or other means can be used to fix the position of the massaging head on the body of the subject. After selection of temperature, pressure, and time the device can be activated.

The control panel is located on the main reservoir. It consists of a pressure controller, a timer to set the operating time, a temperature regulator to regulate the temperature of the water, if any of the optional heating or cooling systems are employed, and a thermometer to monitor the temperature of the water.

Since the massaging head is mobile, the subject can position himself in such a way to have access to the control panel during the entire operation.

The above descriptions contain many specificities and options that make this device to be useful in different settings. The device can be used in a hospital, home, Doctor's office, school, or other settings. The equipment is compact, mobile, and does not require pluming. Patients with arthritic pain, sprain/strain, contusion, muscle tightness, and many other soft tissue lesions can benefit from this device.

Numerous variations and options can be made available depending on the application and budget. The temperature of the water can be adjusted from ice-cold to hot. The cooling system can be operated manually or electrically. To heat the water, a heating element can be placed in the water reservoir. The water pressure can be adjusted to fit the needs by using a pressure-adjustable pump.

The scope of this invention should be determined by the appended claims and their legal equivalents, rather than by the examples given.

What is claimed is:

1. A water-closed system device that utilizes water pressure for massage that does not require an external source of water and does not discharge any water, wherein the device circulates water in a closed system, the device comprising:

a water reservoir that houses a water pump and holds a volume of water;

two flexible hoses, one hose delivers water from the pump and the other hose returns water to the reservoir;

a massage head connected to the two flexible hoses comprises a shell having a flexible contact surface, one of said hoses is adapted to direct water from the pump onto the flexible contact surface for massaging a portion of the user's body, the other hose adapted to return the water from the massage head back to the reservoir, the massage head adapted to be freely positioned at different heights and angles to massage different parts of the user's body.

* * * * *